United States Patent [19]

Yuchi

[11] Patent Number: 4,618,853

[45] Date of Patent: Oct. 21, 1986

[54] FIRE DETECTOR

[75] Inventor: Sadataka Yuchi, Sagamihara, Japan

[73] Assignee: Hochiki Corporation, Tokyo, Japan

[21] Appl. No.: 704,766

[22] Filed: Feb. 21, 1985

[30] Foreign Application Priority Data

Mar. 5, 1984 [JP] Japan ..... 59-41731

[51] Int. Cl.[4] ..... G08B 26/00

[52] U.S. Cl. ..... 340/505; 340/511; 340/512; 340/514; 340/589; 340/870.21; 340/870.24

[58] Field of Search ..... 340/505, 500, 501, 512, 340/514, 518, 588, 589, 511, 870.16, 870.17, 870.19, 870.21, 870.24, 870.11, 825.06–825.1, 825.29, 825.57, 825.63, 825.65; 179/5 R; 375/22

[56] References Cited

U.S. PATENT DOCUMENTS

| | | | |
|---|---|---|---|
| 3,667,046 | 5/1972 | Schoolcraft | 340/870.24 |
| 4,077,030 | 2/1978 | Helava | 340/870.24 |
| 4,087,796 | 5/1978 | Brown | 340/870.21 |
| 4,103,337 | 7/1978 | Whiteside | 340/870.13 |
| 4,311,986 | 1/1982 | Yee | 340/825.63 |
| 4,408,166 | 10/1983 | Moeller | 375/22 |

*Primary Examiner*—Donnie L. Crosland

*Attorney, Agent, or Firm*—Lackenbach Siegel Marzullo Presta & Aronson

[57] ABSTRACT

A fire detector which outputs a change in physical phenomena caused by fire, such as a change in smoke density, in the form of analog voltage signal, by, for example, a photoelectric type sensor, an ionization type sensor, a thermal sensor, a gas sensor or the like, converts the output voltage into a pulse width corresponding to the voltage level by a voltage-pulse width converting circuit, counts quick clock pulses over the pulse width by a pulse counter, and transmits the count output from the pulse counter, in the form of digital signal, to a central signal station.

4 Claims, 8 Drawing Figures

FIRE DETECTOR

BACKGROUND OF THE INVENTION

1. Field of the Invention

This invention relates to a fire detector which is capable of detecting changes in physical phenomena caused by fire, for example a change of smoke density, in the analog form, and transmitting a detection signal to a central signal station after conversion of the same into a digital form.

2. Prior Art

A conventional fire detector, for example a photoelectric type fire detector, which is adapted to detect changes in physical phenomena caused by fire, such as a change of smoke density, in the analog form, convert an analog detection signal into a digital signal and transmit the same to a central signal station, includes, as requisites, a light emitting element such as a light emitting diode etc., a photodetector such as a PIN photodiode etc., an amplifier, a sample-and-hold circuit, an A/D converter, and a transmission control circuit. In this type of fire detector, pulse light is radiated to a smoke detection area from the light emitting element when the detector is called by polling from the central signal station and scattered light is incident upon the photodetector and converted into an electric signal. The so converted signal having a level corresponding to the smoke density is amplified and output from the amplifier. The peak level of the amplified output is detected by the sample-and-hold circuit and converted into a digital signal of given bits by the A/D converter. The digital signal is then transmitted to the central signal station, for example, by serial transmission.

However, since the conventional fire detectors need an amplifier, a sample-and-hold circuit and an A/D converter to convert the analog signal into the digital signal and transmit the signal to the central signal station, the circuit arrangements of the fire detectors are somewhat complicated and expensive.

More particularly, the A/D converter has such problems that it becomes very expensive when the number of bits is increased, which hinders digital transmission of the analog detection signal from becoming more accurate for an economical reason and that it requires strict criticality for a reference voltage for the A/D conversion. the sample-and-hold circuit involves a problem that its circuit arrangement must be very complicated because it is required a high impedance.

SUMMARY OF THE INVENTION

This invention has been achieved to overcome the above-mentioned problems involved in the conventional fire detectors, and it is an object of the present invention to provide a fire detector which is reasonable at cost and simplified in structure and capable of converting an analog signal into a digital signal with high accuracy for transmitting the same to a central signal station.

To attain this object, the present invention is so constructed that circuits of the fire detector are actuated upon receipt of a call by polling from the central signal station to detect a change in physical phenomena such as a change in smoke density by a fire detecting means and output the detection data in the form of analog voltage, the output voltage is converted into a pulse having a width corresponding to the voltage level by a voltage-pulse width converting means, the number of clock pulses is counted by a pulse counter over the pulse width, and the count output from the pulse counter is transmitted, in a digital form, to the central signal station.

As described above, according to the present invention, the sample-and-hold circuit and the A/D converter are replaced by a comparator as a voltage-pulse width converting means and a pulse counter for counting quick clock pulses. Thus, the structure is much simplified and the cost is much reduced as compared with the conventional fire detectors.

Other objects and effects of the present invention will be apparent from the following description.

PREFERRED EMBODIMENTS

Figure 1:
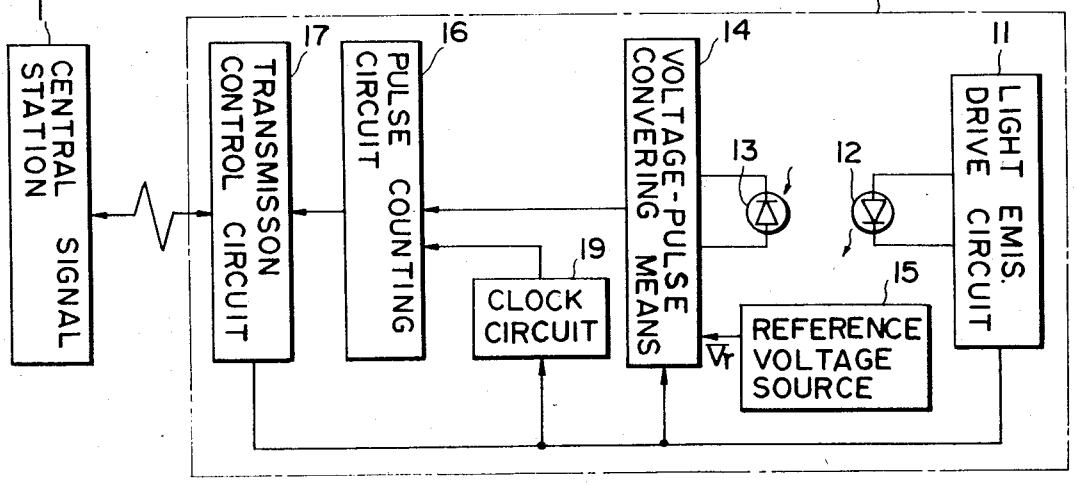
FIG. 1 is a block diagram of a basic arrangement of the present invention.

Prior to explaining preferred embodiments of the present invention, a conventional fire detector will now be described referring to the drawings.

Figure 7:
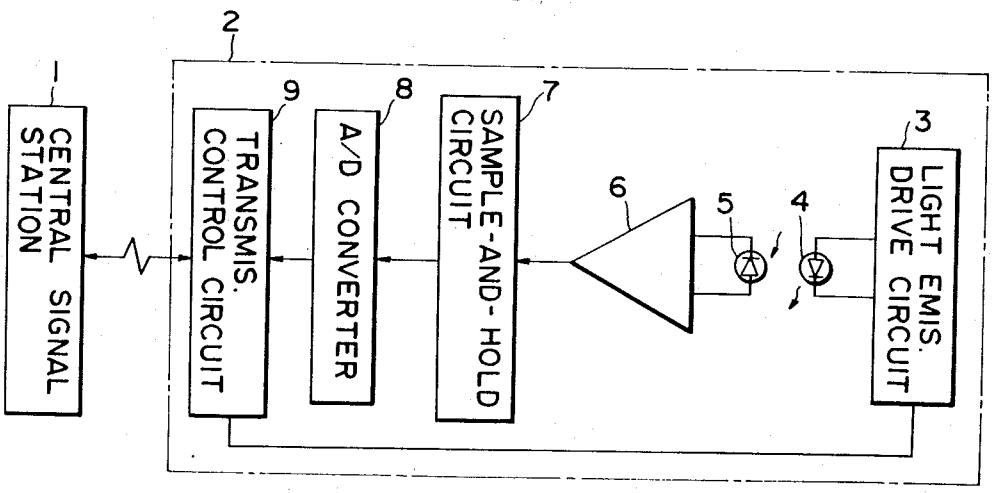
Fig. 7 (PRIOR ART)
FIG. 7 is a block diagram of a basic arrangement of a conventional fire detector.

A fire detector as illustrated in FIG. 7 can be mentioned as an example of a conventional fire detector which converts an analog fire detection signal representing a change in physical phenomena, such as a voltage signal corresponding to the smoke density, into a digital signal and transmits the same to a central signal station.

Figure 8:
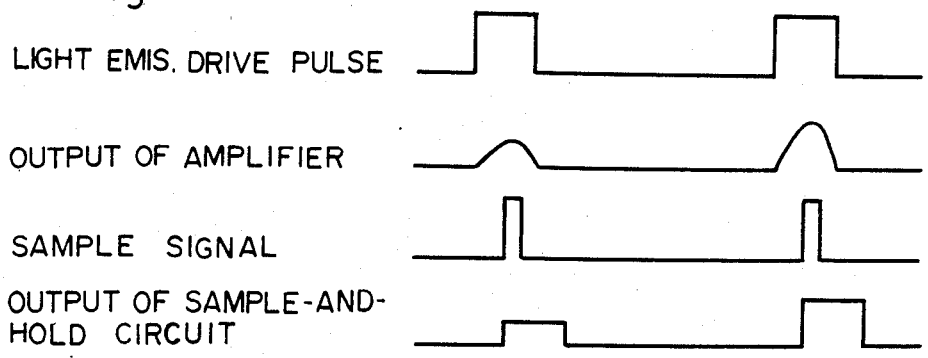
FIG. 8 is a waveform diagram of signals obtained in the conventional fire detector as shown in FIG. 7.

In FIG. 7, 1 is the central signal station and 2 is the fire detector. The fire detector 2 comprises a light emission drive circuit 3, a light emitting element 4 such as a light emitting diode, a photodetector 5 such as a PIN photodiode, an amplifier 6, a sample-and-hold circuit 7, an A/D converter 8 and a transmission control circuit 9. When the fire detector 2 is called by polling from the central signal station 1, the light emission control circuit 3 drives the light emitting element 4 to radiate pulse light into a smoke detection area as shown in the waveform diagram of FIG. 8. The light scattered is incident upon the photo detector 5 and converted into an electrical signal. An output from the amplifier 6 has a level corresponding to the smoke density. The peak level of the amplifier output is detected by the sample-and-hold circuit 7 and converted into a digital signal of given bits by the A/D converter 8. The digital signal is transmitted to the central signal station 1 by serial transmission by the transmission control circuit 9. This type of conventional fire detector has problems as described above.

A basic arrangement of the present invention will now be described.

Referring to FIG. 1, numeral 1 designates a central signal station, and a fire detector 10 of the present invention is connected to the central signal station by a signal line. The fire detector 10 actuates its circuits upon receiving a call by polling from the central signal station to convert an analog fire detection signal in the form of a voltage into a digital signal and transmit the same to the central signal station 1.

The fire detector 10 comprises a light emission drive circuit 11 for driving a light emitting element 12 upon receiving a call by polling from the central signal station 1 and a photodetector 13 such as a PIN photodiode which receives light scattered by smoke incident thereupon. 14 is a voltage-pulse width converting means which compares a photooutput from the photodetector 13 which becomes higher as the smoke density becomes thicker, in the form of an analog detection voltage, with a reference voltage Vr of a reference voltage source 15, and outputs a pulse signal having a pulse width corresponding to the voltage level of the analog detection voltage. 16 is a pulse counting circuit which counts a number of quick clock pulses output from a clock circuit 19 over a width of a pulse signal output from the voltage-pulse width converting means 14 and generates a count output corresponding to the pulse width in the form of a binary code. 17 is a transmission control circuit which has functions of outputting an actuating signal to the light emission drive circuit 11, the clock circuit 19 and the voltage-pulse width converting means 14 when it identifies its address upon receipt of a call by polling from the central signal station 1, converting the digital count output from the pulse counting circuit 16 into a serial data ,and transmitting the same to the central signal station 1.

Figure 2:
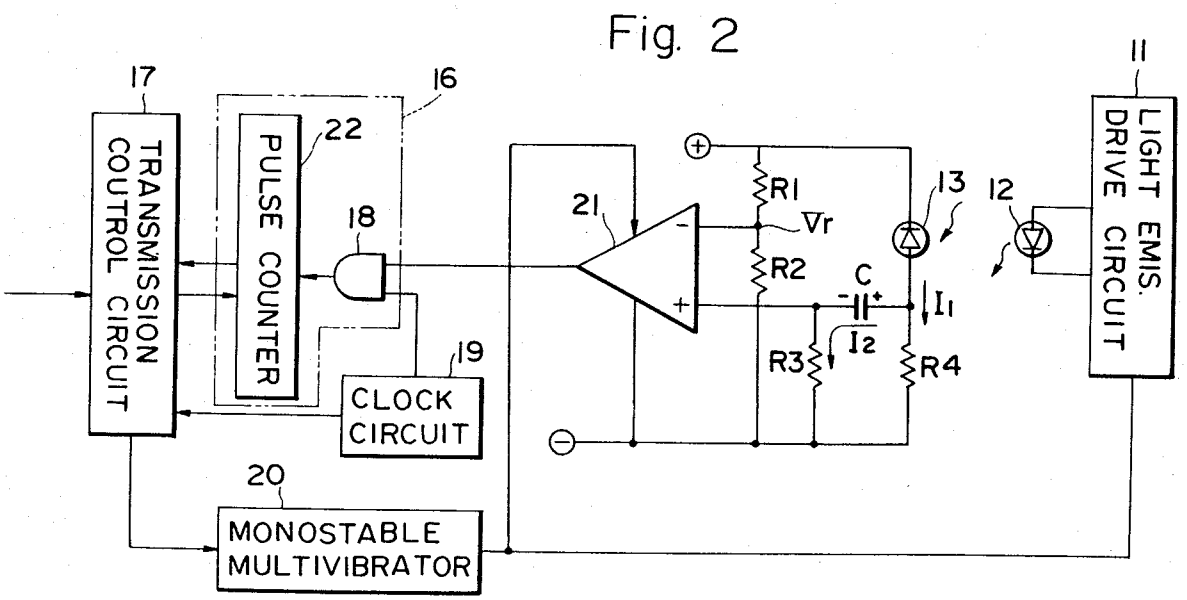
FIG. 2 is a circuit diagram of one embodiment of the present invention.

FIG. 2 illustrates a preferred form of a fire detector according to the basic arrangement of FIG. 1. In FIG. 2, the voltage-pulse width converting means 14 and the pulse counting circuit 16 are illustrated in as typical specific circuits .

The photodetector 13 which receives light from the light emitting element 12 which is scattered by smoke, is connected in series with a resistor R4. The junction of the photodetector 13 and the resistor R4 is connected to a positive input terminal of a comparator 21 through a differentiation circuit comprised of a capacitor C and a resistor R3. A negative input terminal of the comparator 21 is supplied with a reference voltage Vr determined by voltage division by resistors R1 and R2. An output from the comparator 21 is supplied to one input terminal of an AND circuit 18 and an output from the clock circuit 19 is supplied to another input terminal of the AND circuit 18. The clock circuit 19 generates narrow clock pulses of the rate of 500 KHz to 1 MHz. An output from the AND circuit 18 is supplied to the pulse counter 22. The pulse counter 22 receives and counts the clock pulses from the clock circuit 19 during the time that the AND circuit 18 is held in an enabled state by the H-level output from the comparator 21.

A monostable multivibrator 20 is provided to operate the light emission drive circuit 11, the clock circuit 19 and the comparator 21 for a predetermined period of time.

The monostable multivibrator 20 is actuated when the transmission control circuit 17 identifies its address upon receipt of a call by polling from the central signal station 1 and operates the light emission drive circuit 11, the clock circuit 19 and the comparator 21 for the predetermined time. An output from the clock circuit 19 is further supplied to the transmission control circuit 17. The transmission control circuit 17 has a function of converting the count output from the pulse counter 22, i.e. the digital output, into a serial data signal for transmitting it to the central signal station 1.

In the present invention, since a change in a fire detection output such as a change of smoke density is obtained in the form of a change of pulse width, the problems otherwise involved in a fire detector with respect to the amplifier which is used for amplification of the fire detection signal, such as oscillation or noises to the circuits, may be eliminated. In addition, the design and adjustment of the circuit arrangement are simplified.

The high-speed clock pulse to be counted during the pulse width by the pulse counter 22 may be generated by a crystal oscillator. In this case, highly accurate conversion of the analog signal into a digital signal can be attained. The number of the bits of the digital signal can be easily increased by increasing the clock pulse oscillation frequency to enhance the conversion accuracy. The increase of the number of the bits does not substantially increse the cost.

All the circuits after the stage of the comparator 21 are constituted of digital circuits, so that the circuit arrangement can easily be fabricated into an integrated form.

Figure 3:
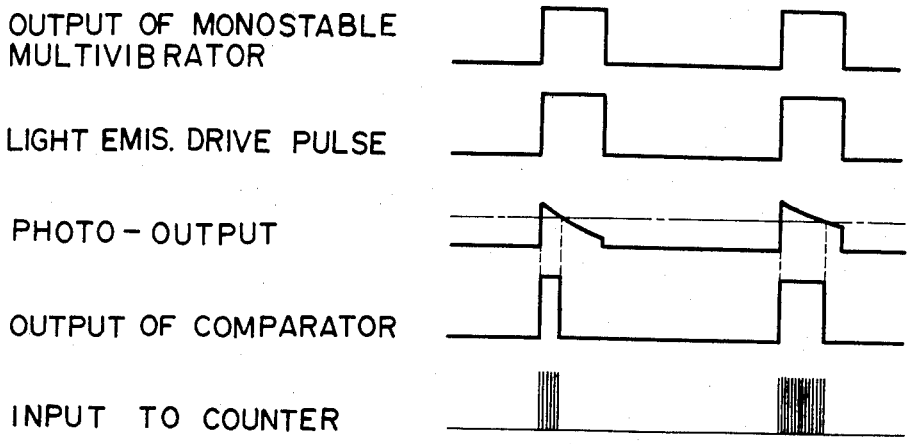
FIG. 3 is a waveform diagram of signals obtained in the embodiment of FIG. 2.
Figure 6:
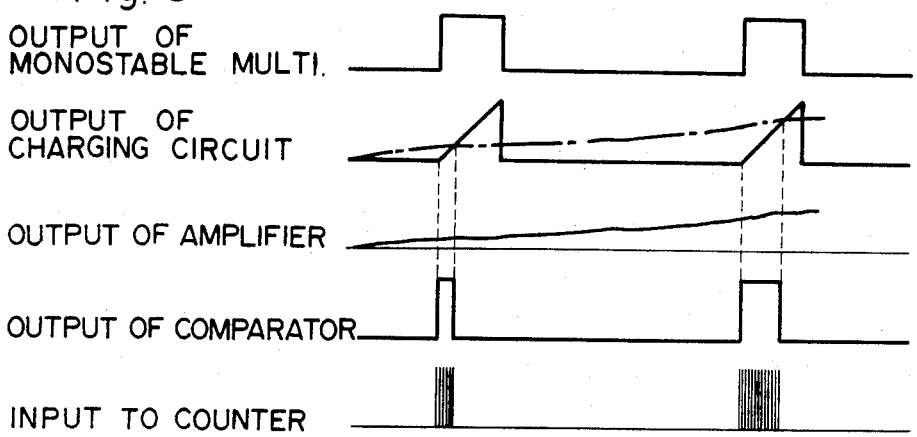
FIG. 6 is a waveform diagram of signals obtained in the embodiment of FIG. 5.

The operation of the embodiment of FIG. 2 will now be described, referring to the waveform diagram of signals as shown in FIG. 3.

Whenever the transmission control circuit 17 recognizes its address upon receipt of a call by polling from the central signal station, the monostable multivibrator 20 is triggered. The monostable multivibrator 20 outputs a drive pulse as in waveform 3(*a*) to the light emission drive circuit 11 for a predetermined time period and supplies power to the comparator 21 and the clock circuit 19 for a predetermined time period in synchronism with the drive pulse. As a result, the light emitting element 12 is driven by the light emission drive circuit 11 in synchronism with the rising of the drive pulse as in waveform 3(*b*) to radiate pulse light into the smoke detection area, and light scattered corresponding to the smoke density in the smoke detection area is incident upon the photodetector 13.

The scattered light is normally very small and the photo-current I1 which flows through the resistor R4 corresponding to the amount of light incident upon the photodetector 13 is also normally small. Therefore, the photo-output voltage waveform a(c), which is provided to the comparator 21 through the differentiation circuit comprised of the capacitor and the resistor R3, initially reaches a certain voltage level in synchronism with the rising of the light emission drive pulse, and then drops as shown by pulse 1 in waveform 3(c).

When scattered light relative to the photodetector 13 is increased due to the increase of the smoke density, the photo-current I1 is increased. As a result, there is obtained a pulse waveform as shown at 2 in waveform 3 (c) for a time of fire wherein the initial level of the photo-output voltage is higher and so takes a longer time to drop to a reference voltage level $V_r$.

The photo-output voltage supplied to the positive input terminal of the comparator 21 is compared with the reference voltage Vr, which is obtained by voltage division by the resistors R1 and R2. When the photo-output exceeds the reference voltage Vr, the comparator 21 produces a H-level output. This H-level output from the comparator 21 puts the AND circuit 18 into an enable state, so that high-speed clock pulses are supplied from the clock circuit 18 to the pulse counter 22. The pulse counter counts the high-speed clock pulses over the time during which the comparator 21 is producing a H-level output.

As a result, the comparator 21 effects conversion into a pulse width corresponding to the initial level of the differentiated analog detection voltage obtained by charging the capacitor C by the current I2 of the photocurrent I1 corresponding to the scattered light incident upon the photodetector 13. The AND circuit 18 is enabled during the pulse width, and the pulse counter 22 counts a number of high-speed clock pulses corresponding to such pulse width. Thus, the analog detection vlotage is converted into digital data.

The count supplied from the pulse counter 22 is output to the transmission control circuit 17 as a binary code and is serial-transmitted to the central signal station under the control of the transmission control circuit 17 in synchoronism with the high-speed clock pulses.

Figure 4:
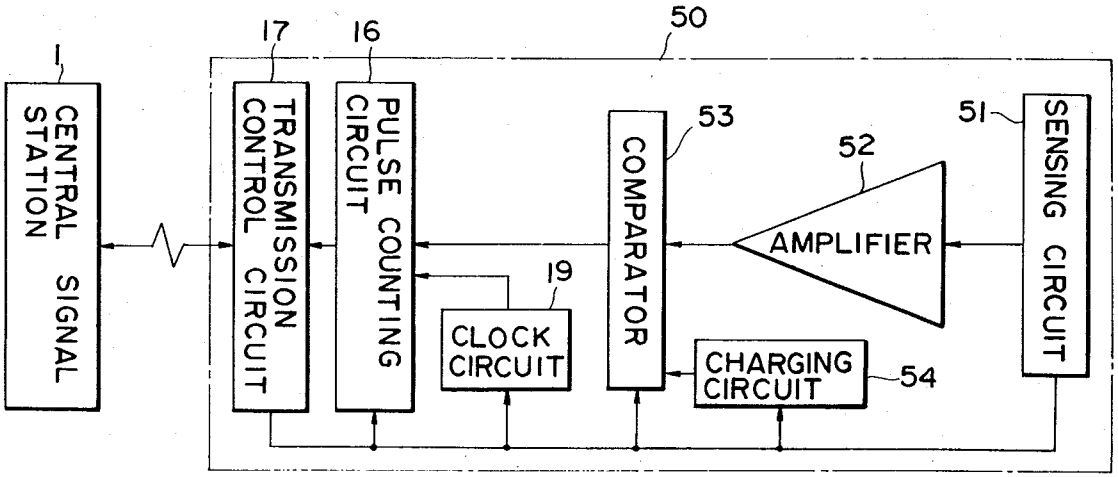
FIG. 4 is a block diagram of another basic arrangement of the present invention.

An alternative circuit embodiment of the present invention will be described. With reference to FIG. 4, in which a fire detector 50 is connected to the central signal station by a signal line. The fire detector actuates circuits therein upon every receipt of a call by polling from the central signal station 1, to convert the fire detection voltage in the analog form into a digital signal and transmit the same to the signal station in substantially the same manner as that of the foregoing embodiment.

A sensing circuit 51 incorporated in the fire detector 50 comprises another type of sensor than a photo-electric type, such as an ionization type sensor, a temperature sensor, a gas sensor or the like. The sensor 51 outputs a detection voltage in an analog amount to an amplifier 52 when called by polling from the central signal station 1 and the amplified output is applied to a comparator 53. The comparator 53 receives an output from a charging circuit 54 which is controlled to be charged and discharged in synchronism with the output timing of the sensing circuit 51. The comparator 53 generates a pulse output having a width corresponding to a time when the output voltage from the amplifier 52 exceeds the voltage at the output terminal of the charging circuit 54. The output of the comparator 53 is processed by a pulse couning circuit 16, a transmission circuit 17 and a clock circuit 19 as described above.

Figure 5:
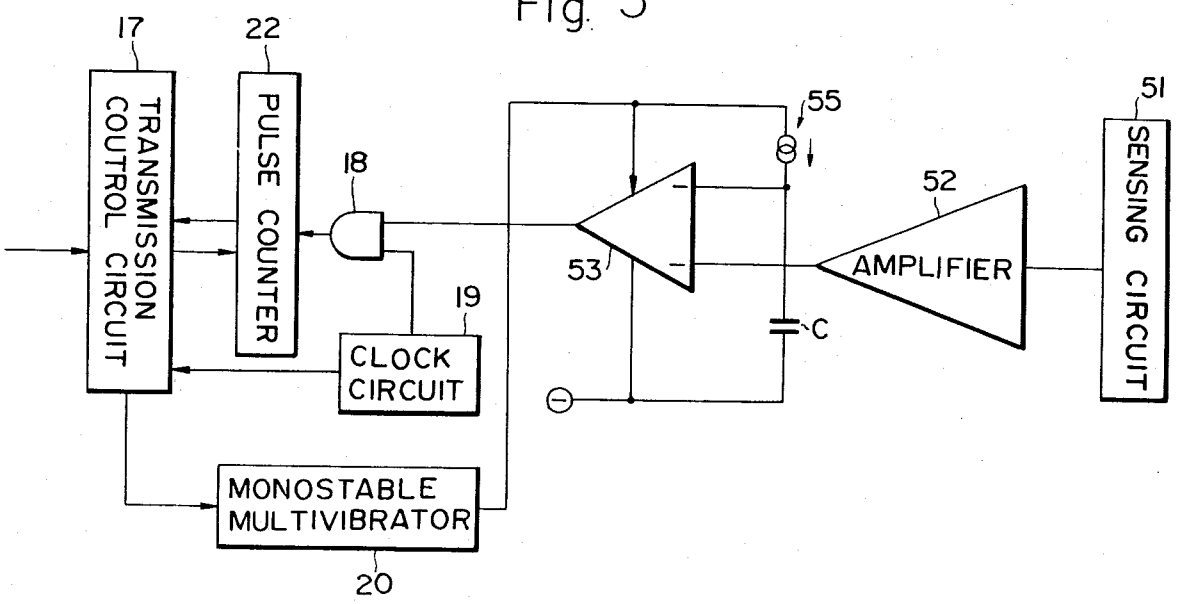
FIG. 5 is a circuit diagram of another embodiment of the present invention.

FIG. 5 illustrates a specific form of a fire detector according to the basic arrangemnet of FIG. 4 a comma especially concerning the charging circuit 54. In FIG. 5 the charging circuit is comprised of a capacitor C and a constant current source 55. The voltage across the capacitor C is applied to an inverse input of the comparator 53. Since the capacitor C is charged by the constant current source 55, the voltage is raised linearly after initiation of the charging as shown by waveform 6 (*b*). The output of the sensing circuit 51 is provided through the amplifier 52 and supplied to a non-inverse input of the comparator 53 as analog data. Therefore, the comparator 53 produces an output only when the output voltage of the amplifier 52 shown by waveform 6 (C) exceeds the voltage of the capacitor C. Thus, the pulse output of the comparator 53, as shown by waveform 6(*d*) changes its pulse width in linear proportions to the output voltage of the amplifier 52. The signal processing operation after the comparator 53 is similar to that in FIG. 2 and therefore further explanation thereof is omitted here.

In the arrangement of FIGS. 4 and 5, if the output from the sensing circuit 51 is sufficiently large, the amplifier is not essential. Especially, when an ionization type sensor which produces high output voltage is employed, the amplifier circuit may be omitted by suitably selecting the charging time constant of a differentiation circuit provided at an input stage of the comparator. In this case, the output of the sensing circuit 51 may be connected directly to the comparator 53. If the charging curve of the differentiation circuit provided at the input stage of the comparator 53 is suitably adjusted, the characteristic curve of the analog fire detection output can be adjusted as desired.

I claim:

1. A fire detector which comprises:

a fire detecting means adapted to be actuated upon receiving a call by polling from a central signal station and to produce an output signifying a change in physical phenomena caused by fire, in the form of an analog voltage;

a voltage-pulse width converting means connected to the fire detecting means for converting the analog output voltage therefrom into a pulse of a width corresponding thereto;

means for generating clock pulses of high frequencies;

a pulse counter connected to the clock pulse and to the pulse width converting means for counting the clock pulses occurring during the duration of the pulse produced by said voltage-pulse width converting means;

means connected to the clock pulse generator for transmitting the count produced thereby to the central station in digital form

2. A fire detector according to claim 1, wherein said voltage-pulse width converting means is a comparator which compares the output voltage from said fire detecting means with a reference voltage and generates an output pulse during the time that the output voltage exceeds the reference voltage.

3. A fire detector according to claim 2, further comprising a comparator which, in response to said polling call is initially charged to the output voltage from said fire detecting means and thereafter discharges to said reference voltage level, said reference voltage level being substantially constant.

4. A fire detector according to claim 2, wherein said reference voltage is produced by a capacitive charging circuit which, in response to said polling call, initiates charging of a capacitor by a constant current source, whereby said reference voltage linearly increases until it exceeds the reference voltage.

* * * * *